US009039315B2

(12) United States Patent
Falkel et al.

(10) Patent No.: US 9,039,315 B2
(45) Date of Patent: May 26, 2015

(54) WRITING APPARATUS

(71) Applicant: Junior's Bullet Pen Company, Littleton, CO (US)

(72) Inventors: Jeffrey E Falkel, Littleton, CO (US); Eric A Probst, Bostic, NC (US); Theodore Probst, Jr., Elmont, NY (US)

(73) Assignee: JUNIOR'S BULLET PEN COMPANY, Littleton, CO (US)

( * ) Notice: Subject to any disclaimer, the term of this patent is extended or adjusted under 35 U.S.C. 154(b) by 288 days.

(21) Appl. No.: 13/796,221

(22) Filed: Mar. 12, 2013

(65) Prior Publication Data

US 2014/0270893 A1 Sep. 18, 2014

(51) Int. Cl.

| | |
|---|---|
| ***A45D 40/20*** | (2006.01) |
| ***B43K 23/00*** | (2006.01) |
| ***B43K 23/12*** | (2006.01) |
| ***B43K 29/00*** | (2006.01) |
| ***B43K 29/007*** | (2006.01) |
| ***B43K 31/00*** | (2006.01) |

(52) U.S. Cl.

CPC ..... *B43K 23/00* (2013.01); *Y10T 29/49888* (2015.01); *B43K 23/001* (2013.01); *B43K 23/12* (2013.01); *B43K 29/00* (2013.01); *B43K 29/007* (2013.01); *B43K 31/00* (2013.01)

(58) Field of Classification Search

CPC ..... B43K 8/00; B43K 8/02; B43K 8/022; B43K 8/024; B43K 23/00; B43K 23/10; B43K 23/12; B43K 23/016

USPC ..... 401/48, 88, 91–93, 131; 473/36; 24/10 R, 11 CC, 11 CT

See application file for complete search history.

(56) References Cited

U.S. PATENT DOCUMENTS

| | | | | |
|---|---|---|---|---|
| 2,398,583 | A * | 4/1946 | Feather | 401/91 |
| 2,497,418 | A * | 2/1950 | Schroeder, Jr. | 401/48 |
| 2,939,426 | A * | 6/1960 | Rodenhauser et al. | 401/247 |
| 3,231,924 | A * | 2/1966 | Lofgren | 401/198 |
| 5,871,294 | A * | 2/1999 | Turner | 401/52 |
| 6,276,854 | B1 * | 8/2001 | Mullins | 401/88 |
| 6,293,721 | B1 * | 9/2001 | Bow et al. | 401/78 |
| 6,322,267 | B1 * | 11/2001 | Shaffer-Bauck | 401/62 |
| 7,232,270 | B1 * | 6/2007 | Goldstein | 401/93 |
| 8,408,831 | B2 * | 4/2013 | Paradise et al. | 401/48 |
| 8,500,353 | B2 * | 8/2013 | Kim | 401/98 |
| 2002/0032069 | A1 * | 3/2002 | Arrison | 473/36 |
| 2007/0020024 | A1 * | 1/2007 | Tsai | 401/116 |

* cited by examiner

*Primary Examiner* — Jennifer C Chiang

(74) *Attorney, Agent, or Firm* — John P. Zimmer; Smith Moore Leatherwood LLP

(57) ABSTRACT

In one aspect, writing apparatus are described herein. In some embodiments, a writing apparatus comprises a bullet casing having a base, a neck, and a cavity disposed between the base and the neck of the casing. The apparatus also comprises a retaining member disposed in the cavity of the casing adjacent the base of the casing. The retaining member is operable to receive and retain a writing implement disposed in the cavity. Further, in some instances, the retaining member is a threaded retaining member such as a threaded cup.

22 Claims, 5 Drawing Sheets

WRITING APPARATUS

FIELD

This invention relates to writing apparatus, and, in particular, to writing apparatus comprising bullet casings.

BACKGROUND

In recent years, the use of writing apparatus formed from bullet casings has increased. However, using bullet casings to form writing apparatus can present various challenges not encountered with other writing apparatus. Improved writing apparatus comprising bullet casings are therefore desired.

SUMMARY

In one aspect, writing apparatus are described herein which, in some embodiments, may provide one or more advantages compared to some other writing apparatus. For instance, in some embodiments, a writing apparatus described herein can securely and reversibly retain a writing implement within a bullet casing, including during storage and normal use of the writing implement. In addition, a writing apparatus described herein can also provide secure and convenient storage of a cap of a writing implement disposed in the apparatus during use of the writing implement, thus facilitating convenient use of the implement.

In some embodiments, a writing apparatus described herein comprises a bullet casing having a base, a neck, and a cavity disposed between the base and the neck of the casing. The apparatus also comprises a retaining member disposed in the cavity of the casing adjacent the base of the casing. The retaining member is operable to receive and retain a writing implement disposed in the cavity. Further, in some instances, the retaining member is a threaded retaining member such as a threaded cup.

Additionally, in some embodiments, an apparatus described herein further comprises a writing implement disposed in the cavity of the bullet casing of the apparatus. Moreover, the writing implement can be reversibly disposed in the cavity of the apparatus. For instance, in some cases, a writing implement is reversibly threaded into a threaded retaining member of the apparatus.

Moreover, in some embodiments, an apparatus described herein can retain a cap of a writing implement disposed in the apparatus during use of the writing implement. For example, in some instances, the bottom of the base of the bullet casing of the apparatus can comprise a rim surrounding a depression. The rim can thus define an inner diameter of the bottom of the base, and, in some embodiments, the rim and the depression can retain the cap of the writing implement.

Further, in some cases, the neck of the bullet casing can provide a tailored fit of a writing implement with the casing. In some embodiments, for example, the neck of the casing comprises an opening providing access to the cavity, and the diameter of the opening matches or substantially matches an outer diameter of the writing implement.

In addition, in some embodiments, the bullet casing of an apparatus described herein can be coated with a coating material. The coating material can be organic or inorganic. In some cases, for instance, the coating material comprises plated nickel or CERAKOTE®.

Moreover, in some instances, the bullet casing of an apparatus described herein can be etched or engraved with textual and/or graphical information, such as a logo or name of a buyer and/or seller of the apparatus.

In another aspect, methods of making a writing apparatus are described herein which, in some embodiments, may provide one or more advantages over other methods. For example, in some cases, a method described herein provides a writing apparatus that can reversibly receive and retain a writing implement within a bullet casing, including in a facile manner. Therefore, in some instances, a method described herein can provide reusable and long-lasting writing apparatus comprising a wide variety of writing implements.

In some embodiments, a method of making a writing apparatus described herein comprises providing a bullet casing having a base, a neck, and a cavity disposed between the base and the neck of the casing; and disposing a retaining member in the cavity of the casing adjacent the base of the casing. The retaining member is operable to receive and retain a writing implement disposed in the cavity. Further, in some embodiments, the retaining member is a threaded retaining member such as a threaded cup. Additionally, in some cases, a method described herein further comprises attaching the retaining member to the base of the casing.

Moreover, in some instances, a method described herein further comprises disposing a writing implement in the cavity of the bullet casing. In some embodiments, disposing the writing implement in the cavity comprises screwing the writing implement into a threaded retaining member of the apparatus.

Further, in some implementations, a method described herein can provide a manner of retaining a cap of a writing implement disposed in the apparatus during use of the writing implement. For example, in some cases, the bottom of the base of the bullet casing comprises a rim surrounding a depression. The rim thereby defines an inner diameter of the bottom of the base. The inner diameter may or may not correspond to the size of a desired writing implement. Thus, in some embodiments, a method described herein further comprises expanding the inner diameter of the bottom of the base to match or substantially match an outer diameter of a cap of the writing implement.

Similarly, in some embodiments, a method described herein can provide a tailored fit of a writing implement in a bullet casing. For instance, in some embodiments, the neck of the bullet casing comprises an opening providing access to the cavity. If desired, a method described herein can comprise reducing the size of the opening to match or substantially match an outer diameter of the writing implement, thereby providing a snug or secure fit in the casing.

In addition, some embodiments of methods described herein further comprise coating the bullet casing of the apparatus with a coating material. The coating material can be organic or inorganic. In some cases, for instance, the coating material comprises plated nickel or CERAKOTE®.

Moreover, in some embodiments, a method described herein further comprises etching or engraving the bullet casing of the apparatus, including with textual and/or graphical information such as a logo or name of a buyer and/or seller of the apparatus.

These and other embodiments are described in greater detail in the detailed description which follows.

BRIEF DESCRIPTION OF THE FIGURES

The drawings referenced herein form a part of the specification. Features shown in the drawings are meant as illustrative of some, but not all, embodiments of the invention, unless otherwise explicitly indicated, and implications to the contrary are otherwise not to be made. Although in the drawings like reference numerals correspond to similar, though not necessarily identical, components and/or features, for the sake of brevity, reference numerals or features having a previously described function may not necessarily be described in connection with other drawings in which such components and/or features appear.

DETAILED DESCRIPTION

In the following detailed description of representative embodiments of the invention, reference is made to the accompanying drawings that form a part hereof, and in which are shown by way of illustration specific examples of embodiments in which the invention may be practiced. While these embodiments are described in sufficient detail to enable those skilled in the art to practice the invention, it will nevertheless be understood that no limitation of the scope of the present invention is thereby intended, Alterations and further modifications of the features illustrated herein, and additional applications of the principles illustrated herein, which would occur to one skilled in the relevant art and having possession of this invention, are to be considered within the scope of this invention. Specifically, other embodiments may be utilized, and logical, mechanical, material, and other changes may be made without departing from the spirit or scope of the present invention.

Accordingly, the following detailed description is not to be taken in a limiting sense, and the scope of the present invention is defined by the appended claims.

In addition, all ranges disclosed herein are to be understood to encompass any and all subranges subsumed therein. For example, a disclosed range of "1.0 to 10.0" should be considered to include any and all subranges beginning with a minimum value of 1.0 or more and ending with a maximum value of 10.0 or less, e.g., 1.0 to 5.3, or 4.7 to 10.0, or 3.6 to 7.9.

I. Writing Apparatus

Figure 1:
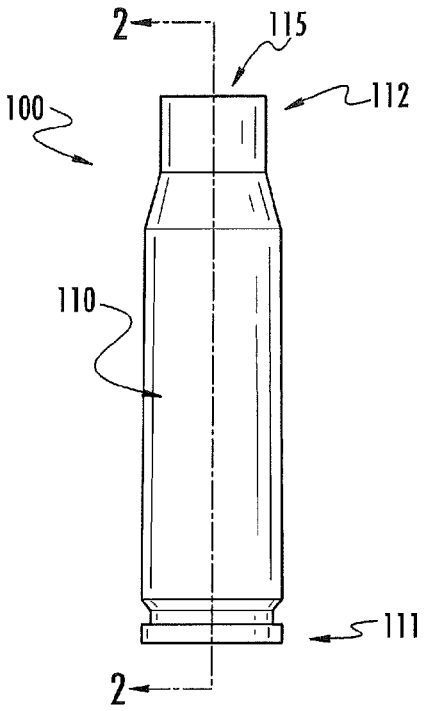
FIG. 1 illustrates a perspective view of a writing apparatus according to one embodiment described herein.

Some embodiments will now be described with reference to the drawings. As shown in FIG. 1, one example implementation of the present invention includes an apparatus (100). The apparatus (100) comprises a bullet casing (110) having a base (111), a neck or throat or mouth (112), and a cavity (113) disposed between the base (111) and the neck (112) of the casing (110). The apparatus (100) also comprises a retaining member (120) disposed in the cavity (113) of the casing (110) adjacent the base (111) of the casing (110). The retaining member (120) is operable to receive and retain a writing implement (not shown) disposed in the cavity (113).

Figure 2:
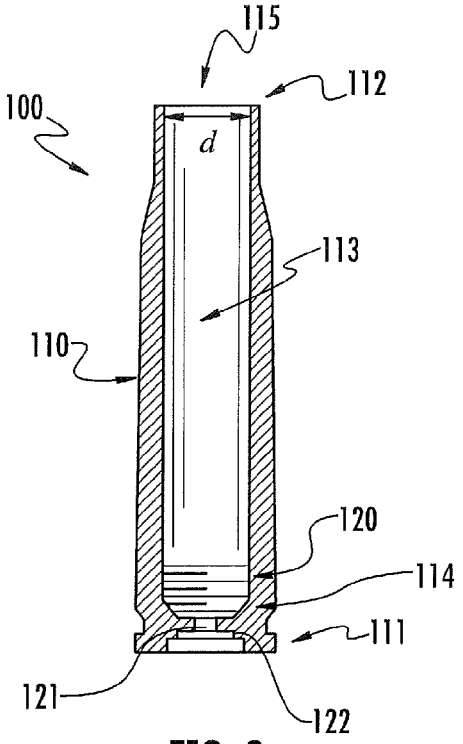
FIG. 2 illustrates a section view of the apparatus of FIG. 1 taken along lines 2-2.

As illustrated in FIG. 1 and FIG. 2, the retaining member (120) is a threaded retaining member comprising a threaded cup. However, other types of retaining members may also be used, as described further hereinbelow. In the embodiment of FIG. 1 and FIG. 2, the threaded cup is operable to receive and retain a writing implement (not shown) in the interior or concave portion (not shown) of the cup.

In addition, the retaining member (120) can be attached to the base (111) of the casing (110). As illustrated in FIG. 1 and FIG. 2, the retaining member (120) is attached to the base (111) using a screw (121) disposed through a threaded hole (not shown) in the bottom of the retaining member (120) as well as a hole (not shown) disposed in the bottom (114) of the cavity (113) of the casing (110). Further, the head (122) of the screw (121) is wider than the holes and is pressed against the bottom (114) of the cavity (113) so as to attach the retaining member (120) to the base (111) of the casing (110), thereby securing it in place. Although a screw mechanism is depicted in FIG. 1 and FIG. 2, a retaining member described herein can also be attached to a base of a casing described herein in other manners as well, as described further hereinbelow.

Moreover, in some instances, the retaining member (120) can be reversibly attached to the base (111) of the casing (110). For example, the retaining member (120) can be reversibly attached to the base (110) using a screw (121) which can be removed if desired, thereby permitting the retaining member (120) to be removed from the cavity (113). Thus, in some embodiments, a retaining member of an apparatus described herein can be easily removed and/or replaced as desired, including by a replacement retaining member having one or more different physical features such as a different size or screw thread structure adapted to receive and retain a different writing implement.

Further, as illustrated in FIG. 1 and FIG. 2, the neck (112) of the casing (110) comprises an opening (115) providing access to the cavity (113). In some cases, the opening (115) has a diameter (d) that matches or substantially matches an outer diameter of a writing implement described herein. For example, a diameter of an opening that substantially matches an outer diameter of a writing implement can have a length that differs from the outer diameter of the implement by no more than about 10 percent, no more than about 5 percent, or no more than about 1 percent, the percentage being based on the longer length of the two diameters.

Figure 3:
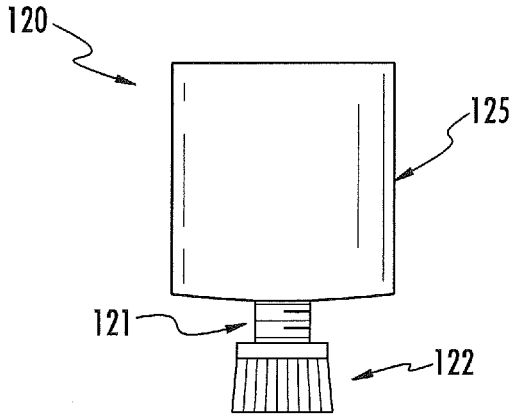
FIG. 3 illustrates a perspective view of a retaining member according to one embodiment described herein.
Figure 4:
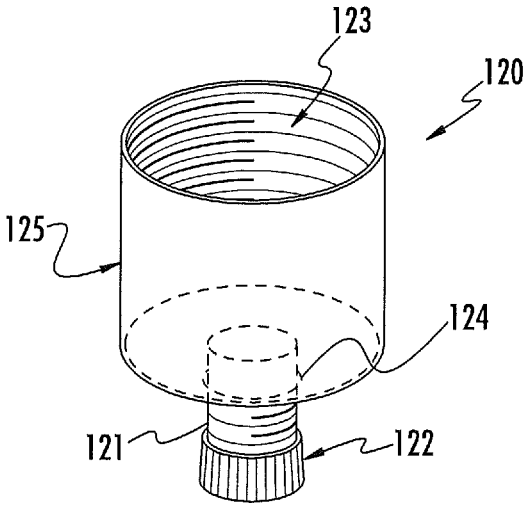
FIG. 4 illustrates another perspective view of the retaining member of FIG. 3.
Figure 5:
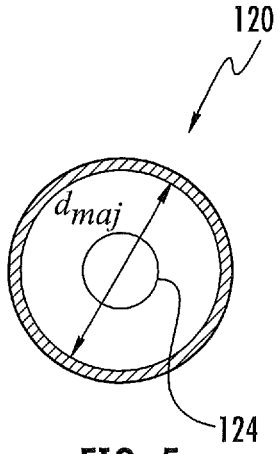
FIG. 5 illustrates a plan view of the retaining member of FIG. 3 and FIG. 4.

FIG. 3 illustrates a retaining member according to one embodiment described herein. FIG. 4 illustrates another view of the retaining member of FIG. 3. FIG. 5 also illustrates the retaining member of FIG. 3 and FIG. 4.

The retaining member (120) of FIGS. 3-5 is a threaded retaining member. The threaded retaining member (120) comprises a screw (121) disposed through a hole (124) in the bottom of a cup portion (125) of the retaining member (120). The hole (124) can be a threaded hole.

Moreover, the threads (123) of the threaded retaining member (120) define a major diameter ($d_{maj}$). In some embodiments, the major diameter ($d_{maj}$) can have the same or substantially the same length as an outer diameter of a writing implement that is to be disposed in the cavity of an apparatus comprising the retaining member (120). In some cases, the major diameter ($d_{maj}$) has a length that is smaller or larger than an outer diameter of the writing implement. For example, in some cases, the major diameter ($d_{maj}$) is no more than about 10 percent, no more than about 5 percent, or no more than about 1 percent larger than the outer diameter, the percentage being based on the longer of the two diameters. In other embodiments, the major diameter ($d_{maj}$) is up to about 10 percent, up to about 5 percent, or up to about 1 percent smaller than an outer diameter of the writing implement. Thus, in some embodiments, a major diameter ($d_{maj}$) of the threaded retaining member (120) can be selected to effectively receive and retain a writing implement disposed in the retaining member, including a writing implement that is screwed into the retaining member.

Figure 6:
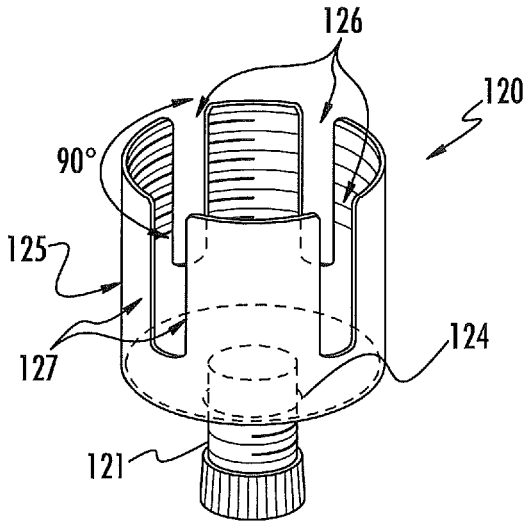
FIG. 6 illustrates a perspective view of a retaining member according to one embodiment described herein.

In addition, in some cases, a retaining member described herein can retain any of a plurality of writing implements disposed in the retaining member, including when the plurality of writing implements have different sizes. FIG. 6 illustrates a retaining member according to one embodiment described herein. The retaining member (120) of FIG. 6 is a threaded retaining member. The threaded retaining member (120) comprises a screw (121) disposed through a hole (124) in the bottom of a cup portion (125) of the retaining member (120). As illustrated in FIG. 6, the cup portion (125) has a substantially cylindrical shape. However, other configurations are also possible. For example, in some embodiments, the cup portion (125) is tapered. A tapered cup portion (125) can be tapered toward the bottom or toward the top of the cup portion (125). In addition, the hole (124) can be a threaded hole.

The retaining member (120) of FIG. 6 also comprises vertical cross-cuts (126) in the cup portion (125). The cross-cuts (126) thus define four stem pieces (127), the stem pieces (127) extending upward toward the open end of the cup portion (125) and being separated from one another around the circumference of the cup portion (125). In the embodiment of FIG. 6, two sets of diametric cross-cuts (126) are disposed at an angle of about 90 degrees. In this arrangement, the four stem pieces (127) are equidistantly disposed about the circumference of the cup portion (125) and are separated from one another in increments of about 90 degrees. However, other arrangements are also possible. The presence of one or more vertical cross-cuts in the cup portion of a retaining member described herein, in some instances, can permit the retaining member to retain a plurality of writing implements, one at a time, even if the writing implements have differing outer diameters. Further, in some embodiments, a retaining member comprising one or more cross-cuts described herein can retain a plurality of differing writing implements even if the threads of the retaining member define a single major diameter in the relaxed state.

A writing implement screwed into a retaining member as described herein, in some cases, comprises or is formed from a soft or deformable material such as a plastic material. For instance, in some embodiments, a writing implement comprises a plastic body. Such a writing implement, in some cases, can be gripped or cut into by the threads of the retaining member, thus permitting the retaining member to retain the writing implement during storage or normal use of the writing apparatus.

Figure 7:
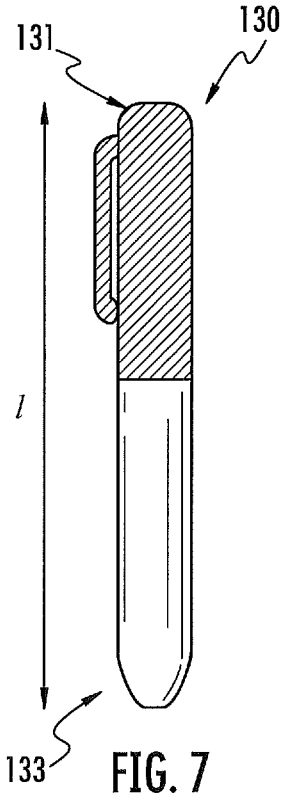
FIG. 7 illustrates a perspective view of a writing implement of a writing apparatus according to one embodiment described herein.
Figure 8:
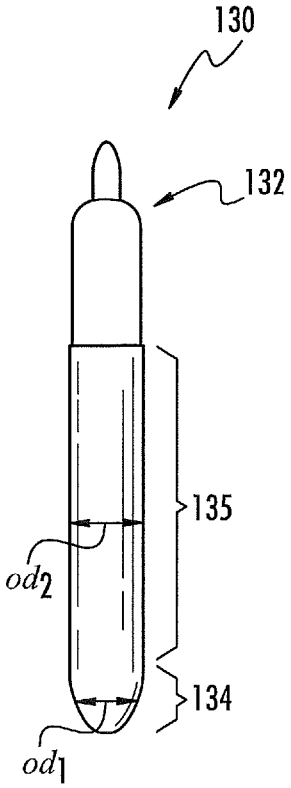
FIG. 8 illustrates a perspective view of a writing implement of a writing apparatus according to one embodiment described herein.

A writing implement described herein can have any outer diameter suitable for use with a retaining member described herein. FIG. 7 illustrates a perspective view of a writing implement according to one embodiment described herein. FIG. 7 illustrates a writing implement (130) with a cap (131) disposed over the tip (132) of the implement (130). For purposes of clarity, FIG. 8 illustrates the same writing implement (130) without the cap (131).

As illustrated in FIG. 7, a writing implement (130) can have a tapered structure, such that the outer diameter of the implement (130) varies along the length (1) of the implement (130), from the tip (132) to the bottom (133). For example, a tapered portion (134) at the bottom (133) of the writing implement (130) can have a first outer diameter ($od_1$), whereas a cylindrical or substantially cylindrical portion (135) closer to the tip (132) of the implement (130) can have a second outer diameter ($od_2$). In some cases, an outer diameter of the tapered portion (134), such as the first outer diameter ($od_1$), is smaller than an outer diameter of the cylindrical or substantially cylindrical portion (135), such as the second outer diameter ($od_2$). As described herein, an outer diameter of the writing implement (130) can be chosen to be smaller, larger, or about the same size as the major diameter of a threaded retaining member described herein. Any suitable outer diameter of the writing implement (130) may be used. In some embodiments, for instance, a first outer diameter ($od_1$) is chosen to be slightly larger than the major diameter of a threaded retaining member by which the writing implement (130) is to be received and/or retained.

Figure 9:
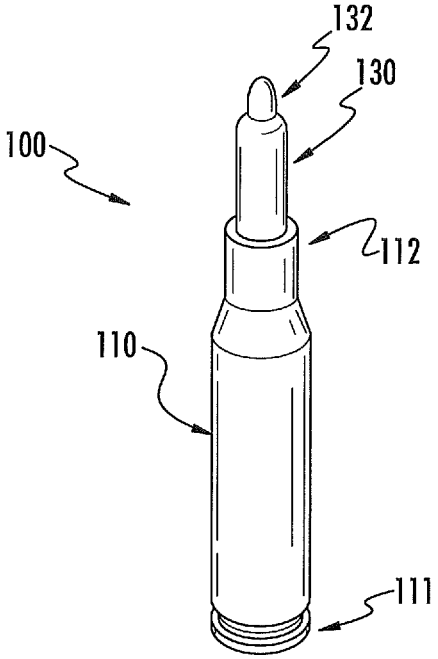
FIG. 9 illustrates a perspective view of a writing apparatus according to one embodiment described herein.
Figure 10:
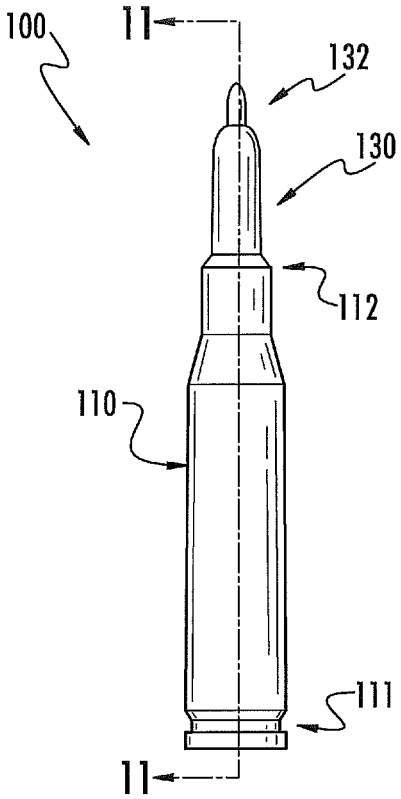
FIG. 10 illustrates another perspective view of the apparatus of FIG. 9.
Figure 11:
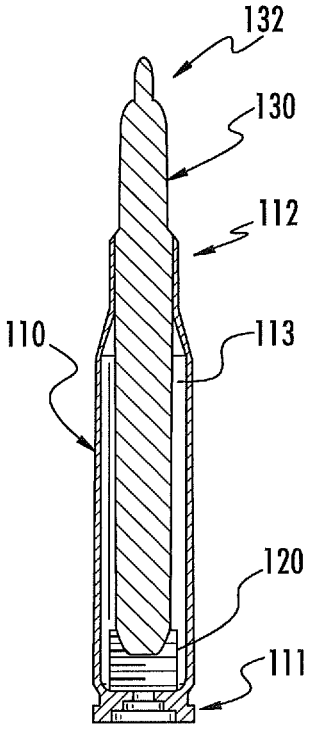
FIG. 11 illustrates a section view of the apparatus of FIG. 10 taken along lines 11-11.

Thus, in some embodiments, a writing apparatus described herein further comprises a writing implement disposed in the cavity of the bullet casing. FIG. 9 illustrates a perspective view of a writing apparatus comprising a writing implement according to one embodiment described herein. FIG. 10 illustrates another perspective view of the apparatus of FIG. 9. FIG. 11 illustrates a section view of the apparatus of FIG. 10 taken along lines 11-11.

As illustrated in FIGS. 9-11, an apparatus (100) comprises a bullet casing (110) having a base (111), a neck (112), and a cavity (113) disposed between the base (111) and the neck (112) of the casing (110). The apparatus (100) also comprises a retaining member (120) disposed in the cavity (113) of the casing (110) adjacent the base (111) of the casing (110). The retaining member (120) is operable to receive and retain a writing implement (130). The writing implement (130) is partially disposed in the cavity (113) of the bullet casing (110) and is operable to write or otherwise mark, as desired by a user. Specifically, the tip (132) of the writing implement (130) is disposed outside of the cavity (113) and above the neck (112) of the casing (110), permitting convenient use of the writing implement (130).

Moreover, in some embodiments, the writing implement (130) can be reversibly disposed in the cavity (113). For example, the writing implement (130) can be reversibly screwed into a threaded retaining member (120), such that screwing the implement (130) in a first direction (such as a clockwise direction) tightens the writing implement (130) into the retaining member (120), and screwing the implement (130) in a second direction (such as a counter-clockwise direction) loosens the writing implement (130) from the retaining member (120), permitting the writing implement (130) to be removed from the cavity (113) if desired. It may be desirable to remove a writing implement (130) for purposes of replacing the implement (130) with a new or different writing implement, such as a writing implement fully charged with ink and/or having different writing or marking characteristics, such as those provided by the tip or ink of the implement.

As illustrated in FIGS. 7-11, the writing implement (130) disposed in the cavity (113) comprises a pen or marker such as a SHARPIE® pen or marker. However, other writing implements can also be used, as described further hereinbelow.

Figure 12:
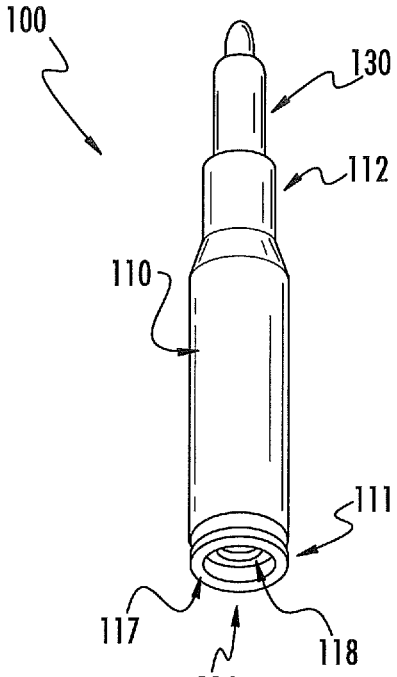
FIG. 12 illustrates another perspective view of the apparatus of FIG. 9.
Figure 13:
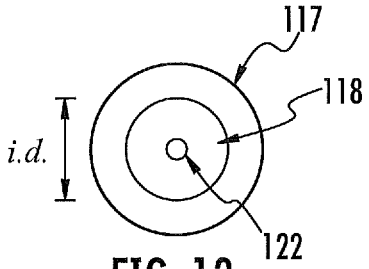
FIG. 13 illustrates a plan view of the bottom of the apparatus of FIG. 12.

Additionally, in some embodiments, an apparatus described herein can be used to retain a cap of a writing implement disposed in the apparatus during use of the writing implement. FIG. 12 illustrates a perspective view of a writing apparatus according to one embodiment described herein. FIG. 13 illustrates a plan view of the apparatus of FIG. 12. As illustrated in FIG. 12 and FIG. 13, the bottom (116) of the base (111) of a bullet casing (110) can comprise a rim (117) surrounding a depression (118). For reference purposes herein, the bottom (116) of the base (111) can be the side of the base (111) that is not adjacent the cavity (113) and retaining member of the apparatus (100).

The depression (118) can be formed in any manner not inconsistent with the objectives of the present invention. For example, in some embodiments, the depression (118) is formed by boring out the middle of the bottom (116) of the bullet casing (110). The rim (117) can thus define an inner diameter (id) of the bottom (116) of the base (111). Moreover, the inner diameter (id), in some cases, has the same or substantially the same length as an outer diameter of a cap of the writing implement, such as a length within about 10 percent of the outer diameter, based on the longer length of the two diameters. In some cases, the inner diameter (id) has a length that is smaller or larger than an outer diameter of the cap. For example, in some cases, the inner diameter (id) is no more than about 10 percent, no more than about 5 percent, or no more than about 1 percent smaller or larger than the outer diameter. Thus, in some embodiments, the rim (117) and the depression (118) are operable to retain a cap of the writing implement (130), including during use of the writing implement (130).

Figure 14:
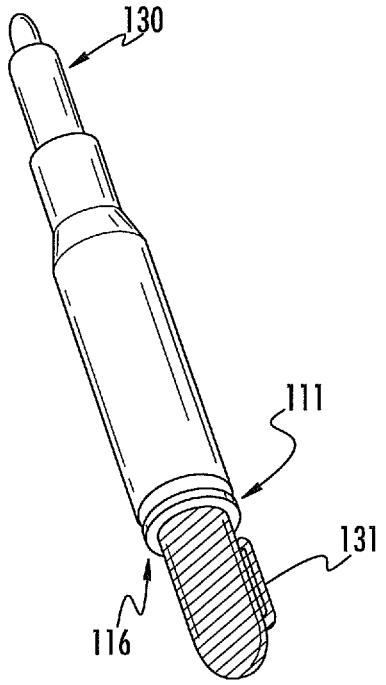
FIG. 14 illustrates a perspective view of an apparatus according to one embodiment described herein.

FIG. 14 illustrates a perspective view of a writing apparatus according to one embodiment described herein, wherein a cap (131) is disposed in the bottom (116) of the base (111).

Turning now to components of apparatus, apparatus described herein comprise a bullet casing having a base, a neck, and a cavity disposed between the base and the neck of the casing. Any bullet casing not inconsistent with the objectives of the present invention may be used. For reference purposes herein, in some instances, a bullet casing comprises a projectile casing for use in a firearm, including a pistol, rifle, machine gun, or shotgun. For example, in some embodiments, a bullet casing described herein is a spent bullet casing that was previously fired from a firearm. Moreover, a spent bullet casing, in some instances, does not comprise any powder, primer, bullet, shot, or other projectile. Instead, in some embodiments, a spent bullet casing comprises only the casing itself.

Alternatively, in other embodiments, a bullet casing, for reference purposes herein, comprises a simulated bullet casing. A simulated bullet casing can comprise a workpiece that is not designed for use with a firearm but is instead designed to mimic the general appearance, weight, and/or shape of a bullet casing, including a spent bullet casing. For example, in some embodiments, a simulated bullet casing is formed by turning and/or boring an aluminum workpiece or other metal workpiece into the size and shape of a standard bullet casing such as a .50 caliber casing. Turning and/or boring a metal workpiece as described herein can be carried out in any manner not inconsistent with the objectives of the present invention. For instance, in some cases, a lathe and/or a mill can be used. A jig borer, boring machine, and/or boring mill may also be used. Additionally, in some instances, a simulated bullet casing can be formed using metal injection molding (MIM), die casting, and/or plastic injection molding (PIM).

Non-limiting examples of casings suitable for use in some embodiments of apparatus described herein include .30 caliber casings, .40 caliber casings, .45 caliber casings, .50 caliber casings (such as .50 caliber BMG (Browning Machine Gun) casings), and .50-110 caliber casings. However, other casings can also be used.

Moreover, a bullet casing for use in a writing apparatus described herein, in some embodiments, is selected based on a desired size of the casing, including in comparison to the size of a writing implement to be disposed in the casing. In some instances, a bullet casing having a neck or cavity of a similar inner diameter as the outer diameter of a writing implement described herein is used. For example, in some embodiments, a .50 caliber BMG casing is selected for use with a SHARPIE® pen or marker or for a highlighter or dry erase marker. In other instances, a .50-110 caliber casing is selected, such as for use with a SHARPIE® "mini" pen or marker.

Additionally, a casing for use in an apparatus described herein can comprise or be formed from any material not inconsistent with the objectives of the present invention. In some embodiments, a casing is formed from a metal, metal alloy, or mixture of metals. For example, in some embodiments, a casing is formed from brass, including military-grade brass. Alternatively, in other instances, a casing is formed from aluminum. In addition, in some embodiments, a bullet casing described herein is formed partially or entirely from a polymer or composite material, including a plastic material. In some instances, for example, a bullet casing is formed from a combination of a polymer or composite material with a metal material, such as a bullet casing comprising a polymeric or composite material body attached to a brass or aluminum base.

Moreover, in some instances, the bullet casing of a writing apparatus described herein can be coated with a coating material. Any coating material not inconsistent with the objectives of the present invention may be used. In some embodiments, a coating material comprises an organic material such as a polymeric material. In other embodiments, a coating material comprises an inorganic material such as a metal, metal oxide, or ceramic material such as CERAKOTE®. A metal coating material can be a pure metal or an alloy or mixture of metals.

In some cases, a bullet casing described herein is coated with a metal plating. For example, in some instances, a bullet casing is coated with plated nickel. In other cases, a bullet casing is plated with gold, silver, rhodium, chrome, or a combination thereof. Metal plating can be carried out in any manner not inconsistent with the objectives of the present invention. In some embodiments, metal plating is carried out using electroplating or electroless plating.

Further, if desired, the bullet casing of a writing apparatus described herein can be etched or engraved. For example, a bullet casing can be etched or engraved with textual or graphical information such as a logo or name. In some instances, the logo and/or name of a buyer, seller, and/or user of the writing apparatus can be etched or engraved on the bullet casing.

Apparatus described herein also comprise a retaining member disposed in the cavity of the casing adjacent the base of the casing. Any retaining member not inconsistent with the objectives of the present invention may be used. For example, in some embodiments, a retaining member comprises or consists of one or more bumps, protrusions, or ridges, including one or more bumps, protrusions, or ridges formed from a tacky, rough, abrasive, or high friction material such as rubber.

In some embodiments, a retaining member described herein is a threaded retaining member. For reference purposes herein, a threaded retaining member comprises a screw thread structure. Moreover, the screw thread structure of a threaded retaining member described herein can be used to receive and/or retain a writing implement as described herein.

Any screw thread structure not inconsistent with the objectives of the present invention may be used. In some cases, for example, a screw thread structure comprises an external or male screw thread. Alternatively, in other instances, a screw thread structure comprises an internal or female screw thread. Further, a screw thread structure can comprise a straight thread structure or a tapered thread structure. A tapered thread structure, in some embodiments, can permit a single threaded retaining member to be used to retain any one of a plurality of differing writing implements having differing outer diameters.

In addition, a screw thread structure of a retaining member described herein can also comprise right-handed thread or left-handed thread. Similarly, a screw thread structure described herein can have any thread form, thread angle, thread depth, pitch, or lead not inconsistent with the objectives of the present invention. A screw thread structure can also have any suitable diameter, including any suitable major diameter, minor diameter, and/or pitch diameter. In some embodiments, a screw thread structure of a threaded retaining member described herein has a major diameter, minor diameter, and/or pitch diameter selected to match or substantially match an outer diameter of a writing implement described herein. In some instances, a screw thread diameter is at least about 1 percent smaller than an outer diameter of a writing implement. In some cases, a screw thread diameter is up to about 15 percent or up to about 10 percent smaller than an outer diameter of a writing implement.

Moreover, a threaded retaining member described herein can be used to provide any fit with the body of a writing implement not inconsistent with the objectives of the present invention. In some cases, for instance, a threaded retaining member provides a fit of class 1, 2, 3, A, or B with a plastic body of a writing implement described herein.

Further, in some embodiments, the screw thread structure of a threaded retaining member described herein is selected based on the size and/or shape of a writing implement to be received and/or retained by the retaining member. Non-limiting examples of screw thread structures suitable for use in threaded retaining members according to some embodiments described herein include those described in ISO 261 and ISO 262, the entireties of which are hereby incorporated by reference. In some cases, a screw thread structure comprises a ⅛×27 NPT (National Pipe Thread) thread or a 7⁄16"×14 tapered thread.

Additionally, if desired, a threaded retaining member having any screw thread structure described herein can also comprise one or more vertical cross-cuts described herein. Any arrangement of cross-cuts not inconsistent with the objectives of the present invention may be used. In some embodiments, for instance, a threaded retaining member comprises four cross-cuts separated by about 90 degrees around the circumference of the retaining member.

Further, a retaining member such as a threaded retaining member or threaded cup can have any physical dimensions not inconsistent with the objectives of the present invention. In some cases, the height of a retaining member such as a threaded cup is selected based on one or more physical dimensions of the bullet casing of an apparatus described herein and/or one or more physical dimensions of a writing implement to be disposed in the casing. For example, in some embodiments, the height of a retaining member is selected to ensure that the tip of a writing implement retained by the retaining member extends outside the cavity and above the neck of the casing. Further, in some instances, the screw thread structure of a threaded retaining member can also be used instead of or in conjunction with a physical dimension of the retaining member to obtained a desired placement of a writing implement in a cavity of an apparatus described herein.

In addition, a retaining member described herein can be formed from any material not inconsistent with the objectives of the present invention. In some instances, for example, a retaining member is formed from a metal, metal alloy, or mixture of metals. In some cases, a retaining member is formed from brass or aluminum. However, other materials may also be used. In some implementations, a retaining member is formed from rubber or plastic.

In some embodiments described herein, a retaining member is attached to the base of a bullet casing. A retaining member can be attached to a base in any manner not inconsistent with the objectives of the present invention. For example, in some embodiments, a retaining member is attached to a base using a screw mechanism, including a screw mechanism or screw thread structure described hereinabove. In other instances, a retaining member is attached to a base using an adhesive, such as an adhesive disposed in the bottom of the cavity of the casing.

Apparatus described herein, in some embodiments, also comprise a writing implement disposed in the cavity of the casing of the apparatus. Any writing implement not inconsistent with the objectives of the present invention may be used. In some embodiments, a writing implement comprises a deformable or soft body or is formed from a deformable or soft material such as plastic. Non-limiting examples of writing implements suitable for use in some embodiments described herein include pens, pencils, markers (including dry erase markers) and highlighters, including SHARPIE® pens or markers or "mini" pens or markers.

II. Methods of Making a Writing Apparatus

In another aspect, methods of making a writing apparatus are described herein. In some embodiments, a method of making a writing apparatus comprises providing a bullet casing having a base, a neck, and a cavity disposed between the base and the neck of the casing; and disposing a retaining member in the cavity of the casing adjacent the base of the casing. The retaining member can be operable to receive and retain a writing implement disposed in the cavity. Further, in some embodiments, the retaining member comprises a threaded retaining member such as a threaded cup.

Additionally, a method described herein, in some implementations, further comprises attaching the retaining member to the base of the casing, including in a reversible manner. For example, a retaining member can be reversibly attached to the base using a screw which can be removed if desired, thereby permitting the retaining member to be removed from the cavity. Thus, in some embodiments, the retaining member can be easily removed and/or replaced as desired, including by a replacement retaining member described herein.

Moreover, in some cases, a method described herein further comprises disposing a writing implement in the cavity of the bullet casing. In addition, disposing the writing implement in the cavity can be carried out in a reversible manner, such that, if desired, the writing implement can be removed from the cavity. For example, in some instances, a writing implement is disposed in the cavity by screwing the writing implement into a threaded retaining member disposed in the cavity. Thus, in some such embodiments, the writing implement can also be unscrewed from the threaded retaining member and removed from the cavity.

Additionally, in some embodiments, a method described herein further comprises coating the bullet casing of the apparatus with a coating material. In some instances, the bullet casing is coated prior to disposing a retaining member in the casing.

In some embodiments, a method described herein further comprises engraving or etching the bullet casing, including prior to disposing a retaining member in the casing and/or before or after coating the bullet casing with a coating material.

Further, in some embodiments, an apparatus made by a method described herein can be used to retain a cap of a writing implement disposed in the apparatus during use of the writing implement. For example, in some embodiments, the bottom of the base of a bullet casing described herein comprises a rim surrounding a depression, the rim defining an inner diameter of the bottom of the base. The inner diameter can be the same or different than an outer diameter of a cap of a writing implement. Therefore, in some embodiments, a method described herein can further comprise expanding the inner diameter of the bottom of the base to match or substantially match an outer diameter of the cap.

Similarly, in some instances, a method described herein can be used to provide a tailored fit of a writing implement in a bullet casing. For instance, in some embodiments, the neck of a bullet casing described herein comprises an opening providing access to the cavity. If desired, a method described herein can comprise reducing the size of the opening to match or substantially match an outer diameter of the writing implement, thereby providing a tailored fit.

Turning now to steps of methods, methods described herein comprise providing a bullet casing having a base, a neck, and a cavity disposed between the base and the neck of the casing. Any bullet casing not inconsistent with the objectives of the present invention may be used, including any bullet casing described hereinabove in Section I. In some embodiments, for example, the bullet casing is a .50 caliber BMG casing or a .50-110 caliber casing.

Additionally, a bullet casing for use in a method described herein, in some embodiments, is selected based on a desired size of the casing, including in comparison to the size of a writing implement to be disposed in the casing. In some instances, for example, a bullet casing having a neck or cavity of a similar inner diameter as the outer diameter of a writing implement described herein is used. Further, in some embodiments, a .50 caliber BMG casing is selected for use with a SHARPIE® pen or marker or for a highlighter or dry erase marker. In other cases, a .50-110 caliber casing is selected, including for use with a SHARPIE® "mini" pen or marker.

Moreover, in some embodiments, a method described herein further comprises coating a bullet casing with a coating material. Coating can be carried out in any manner not inconsistent with the objectives of the present invention. In some cases, coating is carried out by a spraying, dipping or plating process, including prior to disposing a retaining member in the casing.

Further, any coating material not inconsistent with the objectives of the present invention may be used. In some embodiments, a coating material comprises an organic material such as a polymeric material. In other embodiments, a coating material comprises an inorganic material such as a metal, metal oxide, or ceramic material such as CERAKOTE®. A metal material can be a pure metal or an alloy or mixture of metals.

In some cases, a bullet casing described herein is coated with a metal plating. For example, in some instances, a bullet casing is coated with plated nickel. In other embodiments, a bullet casing is plated with gold, silver, rhodium, chrome, or a combination thereof. Metal plating can be carried out in any manner not inconsistent with the objectives of the present invention. In some embodiments, metal plating is carried out using electroplating or electroless plating.

Moreover, in some embodiments, a method described herein further comprises engraving or etching a bullet casing. Engraving or etching can be carried out in any manner not inconsistent with the objectives of the present invention. In some cases, engraving or etching is carried out by a chemical, electrochemical, mechanical, or photo-based engraving or etching process, including prior to disposing a retaining member in the casing. For instance, in some embodiments, one or more of acid etching, ferric chloride etching, anodic etching, photo-etching, hand engraving (using various graver sizes and geometries), machine engraving, and computer-aided machine engraving can be used. Further, in some cases, a bullet casing is etched or engraved with textual and/or graphical information such as a logo or name of a buyer and/or seller of the apparatus, as described further hereinabove.

Methods described herein also comprise disposing a retaining member in the cavity of the casing adjacent the base of the casing. Any retaining member not inconsistent with the objectives of the present invention may be used, including any retaining member described hereinabove in Section I. For example, in some cases, a threaded retaining member is used. Further, in some embodiments, a threaded retaining member described herein is selected based on the size and/or shape of a writing implement to be received and/or retained by the retaining member. Thus, in some instance, the threads of a threaded retaining member are selected to define a major diameter having the same or substantially the same length as an outer diameter of a writing implement to be disposed in the cavity, as described hereinabove. Alternatively, in other instances, the major diameter has a length that is smaller than or larger than an outer diameter of the writing implement.

Methods described herein, in some embodiments, also comprise attaching a retaining member to the base of a bullet casing described herein. A retaining member can be attached to a base in any manner not inconsistent with the objectives of the present invention. For example, in some embodiments, a retaining member is attached to a base using a screw mechanism, including a screw mechanism or screw thread structure described hereinabove. In other instances, a retaining member is attached to a base using an adhesive, such as an adhesive disposed in the bottom of the cavity of the casing.

Methods described herein, in some cases, also comprise disposing a writing implement in the cavity of a bullet casing. Any writing implement not inconsistent with the objectives of the present invention may be used. In some embodiments, a writing implement comprises a deformable or soft body or is formed from a deformable or soft material such as plastic. Such a writing implement, in some cases, can be gripped or cut into by the threads of the retaining member, thus permitting the retaining member to retain the writing implement during storage or use of the writing apparatus. Non-limiting examples of writing implements suitable for use in some implementations described herein include pens, pencils, markers (including dry erase markers) and highlighters, such as SHARPIE® pens or markers or "mini" pens or markers.

Moreover, in some embodiments, a method described herein further comprises expanding an inner diameter of the bottom of the base of a bullet casing to match or substantially match an outer diameter of the cap of a writing implement. For reference purposes herein, an inner diameter that substantially matches an outer diameter of a cap has a length that differs from the outer diameter of the cap by no more than about 10 percent, no more than about 5 percent, or no more than about 1 percent different, based on the longer length of the two diameters.

Further, expanding the inner diameter of a base can be carried out in any manner not inconsistent with the objectives of the present invention. In some embodiments, for instance, the inner diameter is expanding by turning and/or boring the casing. Turning and/or boring a casing as described herein can be carried out in any manner not inconsistent with the objectives of the present invention. For instance, in some embodiments, a lathe and/or a mill can be used. A jig borer, boring machine, and/or boring mill may also be used.

Methods described herein, in some embodiments, also comprise reducing the size of an opening of a casing to match or substantially match an outer diameter of a writing implement, including a writing implement that is or will be disposed in the casing. For reference purposes herein, a diameter of an opening that substantially matches an outer diameter of a writing implement has a length that differs from the outer diameter of the implement by no more than about 10 percent, no more than about 5 percent, or no more than about 1 percent, based on the longer length of the two diameters.

Reducing the size of an opening of a casing to match or substantially match an outer diameter of a writing implement can be carried out in any manner not inconsistent with the objectives of the present invention. In some embodiments, for instance, reducing the size of the opening comprises crimping the opening, such as with a crimping tool.

Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the invention.

That which is claimed is:

1. An apparatus for retaining a writing implement comprising a body, the apparatus comprising:

a casing having a base, a neck, and a cavity extending longitudinally between the base and the neck of the casing; and a threaded retaining member disposed in the cavity of the casing adjacent the base of the casing and attached to the base of the casing, wherein the body of the writing implement is received and retained in the threaded retaining member; and wherein the bottom of the base comprises a flat rim.

2. The apparatus of claim 1, wherein the threaded retaining member comprises a threaded cup.

3. The apparatus of claim 2, wherein the threaded cup comprises one or more vertical cross-cuts.

4. The apparatus of claim 1, wherein the threads of the retaining member define a major diameter having the same or substantially the same length as an outer diameter of the writing implement.

5. The apparatus of claim 1, wherein the writing implement is screwed into the threaded retaining member.

6. The apparatus of claim 1, wherein the writing implement comprises a plastic body.

7. The apparatus of claim 1, wherein the rim surrounds a depression and defines an inner diameter of the bottom of the base, and wherein the rim and the depression are operable to retain a cap of the writing implement.

8. The apparatus of claim 1, wherein the neck of the casing comprises an opening providing access to the cavity and the opening has a diameter that matches or substantially matches an outer diameter of the writing implement.

9. The apparatus of claim 1, wherein the casing is coated with a coating material.

10. The apparatus of claim 1, wherein the writing implement comprises a deformable body.

11. The apparatus of claim 1, wherein the writing implement is selected from the group consisting of pens, pencils, markers, and highlighters.

12. The apparatus of claim 1, wherein the casing is a bullet casing.

13. The apparatus of claim 1, wherein the threaded retaining member is attached to the base using a screw mechanism or adhesive.

14. The apparatus of claim 1, wherein a tip of the writing implement extends outside the cavity and above the neck of the casing.

15. The apparatus of claim 3, wherein the vertical cross-cuts define a plurality of stem pieces extending upward toward an open end of the threaded cup.

16. The apparatus of claim 3, wherein the vertical cross-cuts comprise two sets of diametric cross-cuts disposed at an angle of about 90 degrees.

17. A method of making an apparatus comprising:

providing a bullet casing having a base, a neck, and a cavity extending longitudinally between the base and the neck of the casing;

disposing a threaded retaining member in the cavity of the casing adjacent the base of the casing;

attaching the threaded retaining member to the base of the casing; and disposing a writing implement in the cavity of the bullet casing, the writing implement comprising a body, wherein the threaded retaining member receives and retains the body of the writing implement; and wherein the bottom of the base of the casing comprises a flat rim.

18. The method of claim 17, wherein the threads of the retaining member define a major diameter having the same or substantially the same length as an outer diameter of the writing implement.

19. The method of claim 17, wherein disposing the writing implement in the cavity comprises screwing the writing implement into the threaded retaining member.

20. The method of claim 17, wherein the rim surrounds a depression and defines an inner diameter of the bottom of the base.

21. The method of claim 20 further comprising expanding the inner diameter of the bottom of the base to match or substantially match an outer diameter of a cap of the writing implement.

22. The method of claim 17, wherein the neck of the casing comprises an opening providing access to the cavity; and wherein the method further comprises reducing the size of the opening to match or substantially match an outer diameter of the writing implement.

* * * * *